US007265607B1

(12) United States Patent
Rajapandian et al.

(10) Patent No.: US 7,265,607 B1
(45) Date of Patent: Sep. 4, 2007

(54) VOLTAGE REGULATOR

(75) Inventors: Saravanan Rajapandian, New York, NY (US); Peter Hazucha, Beaverton, OR (US); Tanay Karnik, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 144 days.

(21) Appl. No.: 10/930,200

(22) Filed: Aug. 31, 2004

(51) Int. Cl.
*G05F 1/10* (2006.01)

(52) U.S. Cl. ..... 327/541; 323/316

(58) Field of Classification Search ..... 327/534, 327/535, 537, 540, 541; 323/316, 273, 280
See application file for complete search history.

(56) References Cited

U.S. PATENT DOCUMENTS 4,551,670 A * 11/1985 Anders et al. ..... 323/281
6,130,526 A * 10/2000 Yang et al. ..... 323/272
6,198,306 B1 * 3/2001 Sessions ..... 326/83
6,201,434 B1 * 3/2001 Kanda et al. ..... 327/538
6,388,477 B1 * 5/2002 Juang ..... 327/112
6,437,638 B1 * 8/2002 Coles et al. ..... 327/540
6,501,252 B2 * 12/2002 Fujise ..... 323/274
6,653,891 B1 11/2003 Hazucha
6,661,212 B2 * 12/2003 Ostrom ..... 323/276
7,042,274 B2 * 5/2006 Hazucha et al. ..... 327/534
2005/0057232 A1 * 3/2005 Tam et al. ..... 323/268
2005/0242791 A1 * 11/2005 Rajapandian et al. ..... 323/268

* cited by examiner

*Primary Examiner*—Kenneth B. Wells
*Assistant Examiner*—Thomas J. Hiltunen
(74) *Attorney, Agent, or Firm*—Troutman Sanders LLP; James Hunt Yancey, Jr.

(57) ABSTRACT

A device comprises an active-pull-up stage and an active-pull-down stage. The device receives at least one reference voltage and provides an regulated output voltage to at least one load. The active-pull-up and active-pull-down stages are adapted to source or sink a current delivered to or received from the at least one load to regulate the output voltage provided to the at least one load. Other embodiments and methods are also claimed and described.

15 Claims, 6 Drawing Sheets

VOLTAGE REGULATOR

An integrated circuit chip, such as a microprocessor, often requires multiple and different supply voltages for different parts of the chip. Various supply voltages may reduce power consumption of certain components by utilizing a lower voltage than other components on the chip. A main supply voltage may be provided to the chip from an off-chip source, and an on-chip power converter may be used to generate additional supply voltages from the main supply voltage. When the main supply voltage from an off-chip source is the highest of the supply voltages used in the chip, a series voltage regulator ("SVR") may be used to obtain the other supply voltages from the main supply voltage.

The general principles of SVRs are known in the art and a traditional SVR 100 is illustrated in FIG. 1. SVR 100 includes a variable resistor $R_1$ connected between a main power supply with voltage $V_{IN}$ and an output voltage $V_{OUT}$. For a constant load current $I_{LOAD}$ 115, the value of $R_1$ may be constant. If, however, $I_{LOAD}$ changes over time, a differential amplifier 105 connected to a reference voltage $V_{REF}$ may dynamically adjust the value of $R_1$ to keep output voltage $V_{OUT}$ substantially constant. $V_{REF}$ may be generated, for example, by using a band-gap reference circuit that produces a constant voltage independent of operating temperature and processing conditions. A second resistor, $R_2$, may be connected between output node 120 and ground 130 to achieve better control of the output voltage $V_{OUT}$. Traditional SVRs may also utilize decoupling capacitors (not shown) to smooth or filter the voltage provided to load 115. Traditional SVRs, while fulfilling their respective purposes, are not capable of providing continuous current flow for multiple digital loads which can switch at very high frequencies or respond very quickly to load variations while minimizing the size of any decoupling capacitors and the die area.

What is needed, therefore, is a voltage regulator that is capable of providing a constant voltage by compensating the current provided to or received from a plurality of digital logic loads. A voltage regulator that quickly sinks or sources current from multiple digital loads without utilizing a large decoupling capacitor is also needed to conserve die area.

DETAILED DESCRIPTION

The various embodiments of the present invention provide a voltage regulator device, system, and method capable of actively regulating a voltage level output. Some embodiments of the invention may be utilized in applications where multiple voltages are required on a chip, but only a single supply voltage is available to provide the multiple voltages. Additionally, some embodiments of the present invention may be used to generate multiple voltages for a processor or other component to reduce power consumption and the heat energy produced by the processor or other component. Other embodiments of the present invention additionally provide a device and method for actively adjusting an output voltage level to approximate a reference voltage that may be an intermediate voltage between multiple series connected loads. Still other embodiments of the present invention provide a system capable of quickly sourcing or sinking current to adjust a voltage level to approximate a reference voltage. These features of some embodiments of the present invention may enable a voltage regulator system to efficiently and effectively regulate an output voltage while decreasing the size of any decoupling capacitors that may be utilized with such a voltage regulation system.

Figure 1:
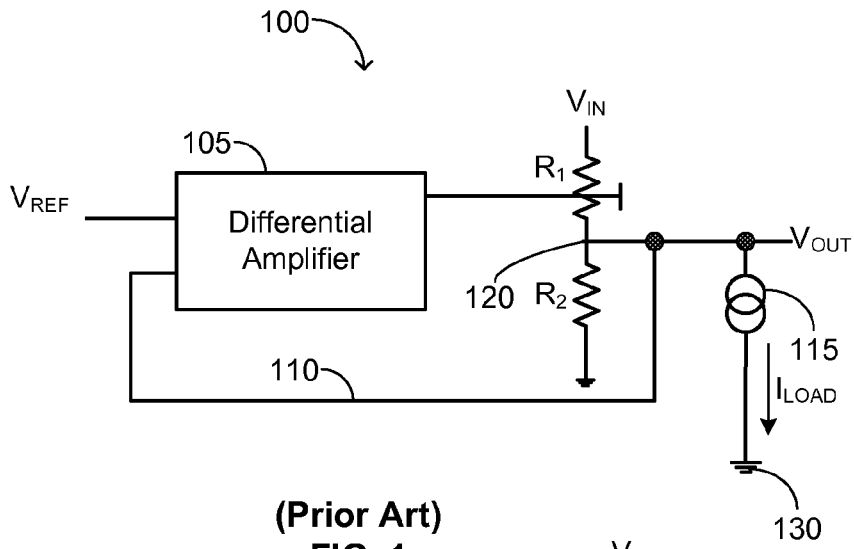
(Prior Art) FIG. 1
FIG. 1 is a block diagram of a prior art series voltage regulator.

Referring now to the figures, FIG. 1 is a block diagram of a prior art series voltage regulator 100. Voltage regulator 100, as mentioned above, may include differential amplifier 105, variable resistor $R_1$, and resistor $R_2$. Differential amplifier 105 receives a reference voltage, $V_{REF}$, and controls $R_1$ via a feedback loop 110 to control $V_{OUT}$ to depend from $V_{REF}$, that is, approximately $KV_{REF}$, where K is a scale factor that may be greater than, less than, or equal to 1, as required for the particular application. Load 115 may change over time such that it requires more or less current and this fluctuation in current may tend to cause $V_{OUT}$ to change. When $V_{OUT}$ changes, feedback loop 110 may allow differential amplifier 105 to adjust $R_1$ so that $V_{OUT}$ may be maintained at approximately $KV_{REF}$.

Figure 2:
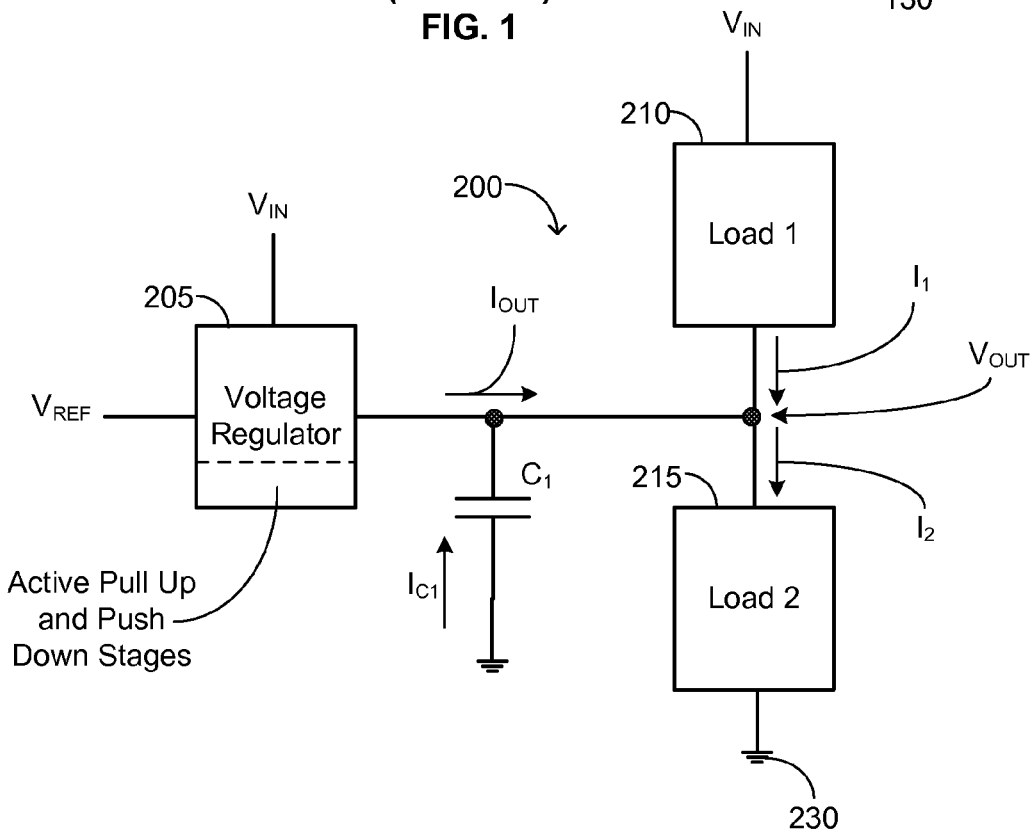
FIG. 2 is a block diagram of an embodiment of the present invention shown with multiple loads.

FIG. 2 is a block diagram of a system 200 of the present invention utilizing a voltage regulator in accordance with some embodiments of the present invention. As shown, system 200 generally comprises voltage regulator 205 and loads 210, 215. Some embodiments of the present invention may also comprise a capacitor $C_1$ which may provide decoupling or filtering characteristics. System 200 may be used to provide an output current, $I_{OUT}$, such that an output voltage, $V_{OUT}$, may be approximately or substantially equal to $KV_{REF}$. System 200 receives an input supply voltage $V_{IN}$ and supplies $I_{OUT}$ to loads 210, 215 having load currents $I_1$ and $I_2$, respectively. Load 210 receives $V_{IN}$ and has current $I_1$, and load 215 receives $V_{OUT}$ and has current $I_2$. As loads 210, 215 may be connected in series, system 200 adjusts $I_{OUT}$ so that $V_{OUT}$ remains substantially equal to $KV_{REF}$. Voltage regulator 200 may source or sink current via $I_{OUT}$ so that $I_{OUT}+I_1$ may be approximately equal to $I_2$. For example, in some embodiments, voltage regulator 205 may comprise an active pull-up stage (or push-up stage) to source the current $I_{OUT}$ to raise $V_{OUT}$. Similarly, some embodiments may comprise an active pull-down (or push-down stage) stage to sink (or draw) the current from $I_{OUT}$ to lower $V_{OUT}$. Capacitor $C_1$ may be used in some embodiments of system 200 to provide decoupling and/or filtering. A goal of system 200 is to adjust $I_{OUT}$ sufficiently fast in response to current/voltage fluctuations in loads 210, 215 so that $V_{OUT}$ approximately equals $KV_{REF}$ at all times. Some embodiments may not utilize capacitor $C_1$ or may utilize a small capacitor if system 200 is capable of responding sufficiently to changes in $V_{OUT}$. For convenience of discussion below, K is presumed to be equal to 1, but in other embodiments, K may have other values.

Figure 3:
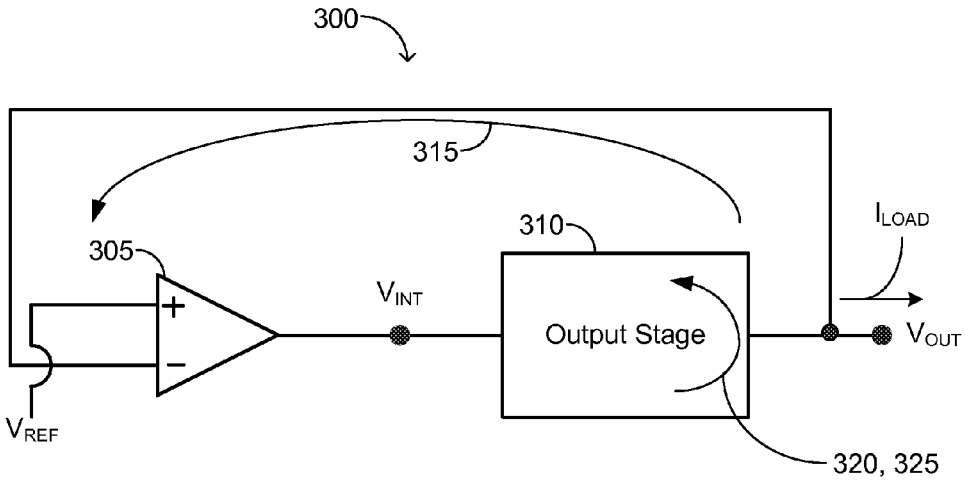
FIG. 3 is a block diagram of another embodiment of the present invention.

FIG. 3 is a block diagram of another embodiment of a voltage regulator 300 in accordance with some embodiments of the present invention. FIG. 3 shows an embodiment of the present invention that may be suitable for use in applications that may require a large variable current and a small average or base current. For example, some embodiments may be used to generate body bias voltages while other embodiments generate an analog reference voltage with dominating capacitive load. Voltage regulator 300 includes an amplifier 305 connected to a output stage 310, which may be a low impedance output stage in some embodiments. Output stage 310 may receive an internal reference voltage $V_{INT}$ from amplifier 305 and may generate an output voltage $V_{OUT}$. The output stage 310 may have internal feedback loops 320, 325 allowing output stage 310 to rapidly adjust $I_{OUT}$ in response to abrupt load changes. In other words, the output stage 310 may adjust the variable current component of $V_{OUT}$ so that $V_{OUT}$ remains substantially constant relative to $V_{INT}$.

Amplifier 305 may be used to adjust the average level of $V_{OUT}$ so that $V_{OUT}$ approximates $V_{REF}$. Amplifier 305 may be a differential amplifier, but other amplifier types may be utilized. A positive input of the differential amplifier 305 may be connected to $V_{REF}$. A negative input of amplifier 305 may be connected to $V_{OUT}$, forming a feedback loop 315. The feedback loop 315 may cause differential amplifier 305 to adjust $V_{INT}$ so that the average level of $V_{OUT}$ is substantially equal to $V_{REF}$. In some embodiments, the output stage 310 may have fast internal feedback loops 320, 325, which may be faster than feedback loop 315, such that the delay in feedback loop 315 may not degrade the ability of the output stage 310 to rapidly adjust $I_{OUT}$, so $V_{OUT}$ remains substantially constant relative to $V_{INT}$. The differential amplifier 305 accordingly may only have to adjust $V_{INT}$ so that the average level of $V_{INT}$ tracks $V_{REF}$. Therefore, the response time of the feedback loop 315 may be at a lower frequency than the response time of internal feedback loops 320 and 325 without degrading the ability of the voltage regulator 300 to adapt to rapidly varying load conditions to provide a constant $V_{OUT}$.

An advantage of some embodiments of the present invention is that they may be used in applications with rapidly changing voltages across series connected loads requiring approximately equal currents. Another advantage of some embodiments is that it may be possible to use a simple, low-cost differential amplifier having a slower response time while still allowing $V_{OUT}$ to accurately track $V_{REF}$ under rapid load variations. An important difference between voltage regulator 300 and the prior art voltage regulator 100 of FIG. 1 is that for the prior art voltage regulator in FIG. 1, the feedback loop 110 needs to be as fast as possible so that the output voltage $V_{OUT}$ may be quickly adjusted in response to the load current variations. Voltage regulator 100 operates by comparing $V_{OUT}$ with $V_{REF}$ and using amplifier 100 to adjust $R_1$ so that the difference between $V_{OUT}$ and $V_{REF}$ is minimized. In contrast, voltage regulator 300 in FIG. 3, it is not necessary for the feedback loop 315 to have a fast response time to compare $V_{OUT}$ with $V_{REF}$ because the output stage 310 may utilize internal feedback loops 320, 325 with a fast response time to adjust $V_{OUT}$. One internal feedback loop may be part of an active pull-up stage to source current thereby raising $V_{OUT}$, and another internal feedback loop may be part of an active pull-down stage to sink current to lower $V_{OUT}$. Internal feedback loops 320, 325 of the output stage 310, may cause $V_{OUT}$ to quickly adjust to load current variations. The feedback loop 315 may have a slower response time since the internal reference voltage $V_{INT}$ only has to be adjusted so that the average value of $V_{OUT}$ tracks $V_{REF}$, rather than $V_{INT}$.

Figure 4:
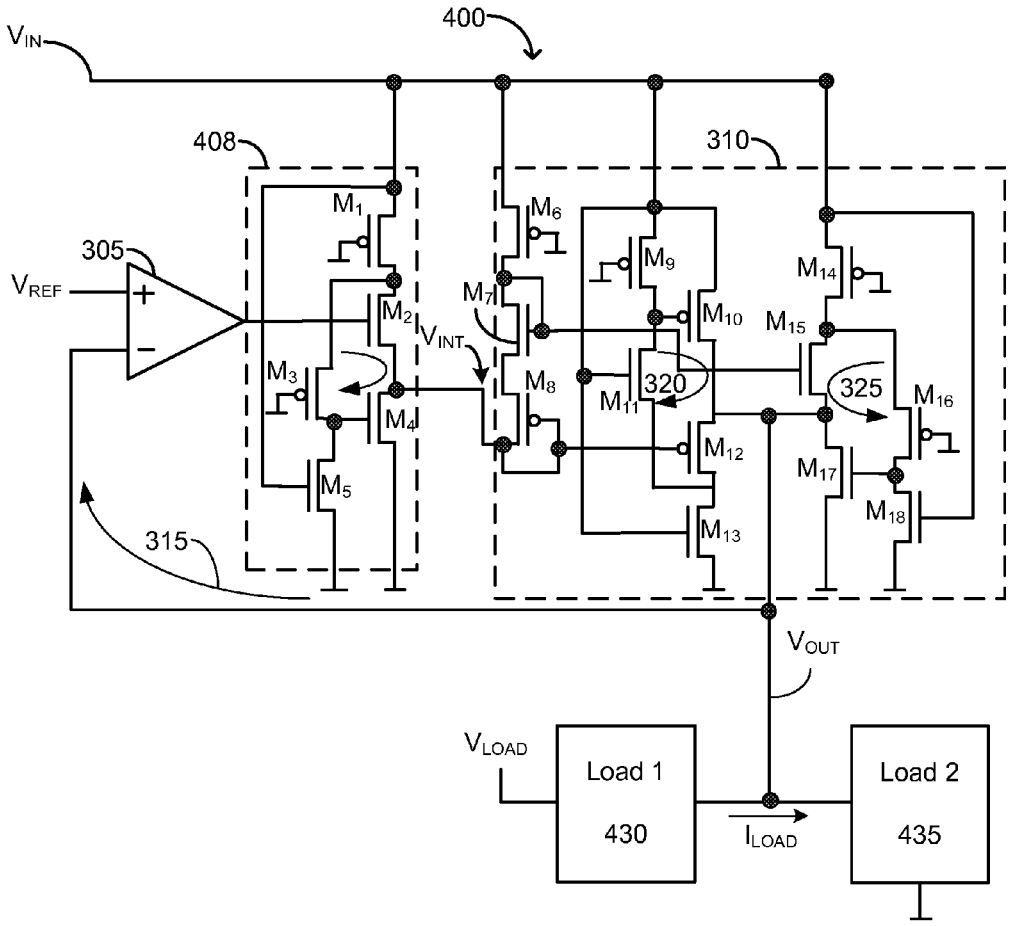
FIG. 4 is a schematic representation of an embodiment of the present invention shown with a single output stage and multiple loads.

FIG. 4 is a detailed schematic representation of an embodiment of the voltage regulator 300 shown with multiple loads 430, 435. Internal feedback loops 320 and 325 are also shown implemented with various N-type and P-type transistors. Feedback loop 320 is shown with transistors $M_{10}$, $M_{11}$, and $M_{12}$. In some embodiments, $M_{10}$ may be a P-type transistor, $M_{11}$ may be an N-type transistor, and $M_{12}$ may be a P-type transistor. Feedback loop 325 is shown with transistors $M_{15}$, $M_{16}$, $M_{17}$, and $M_{18}$. In some embodiments, $M_{15}$, $M_{17}$, and $M_{18}$ may be N-type transistors, and $M_{16}$ may be a P-type transistor. Output stage 310 is also shown with various other transistors and those skilled in the art will understand that other transistor configurations may also be possible in accordance with other embodiments of the present invention.

Also illustrated in FIG. 4 is buffer 408 as some single output stage embodiments of the present invention may utilize buffers. Buffer 408 may comprise transistors $M_1$, $M_2$, $M_3$, $M_4$, and $M_5$. Transistors $M_1$ and $M_3$ may be P-type transistors and transistors $M_2$, $M_4$, and $M_5$ may be N-type transistors. Buffer 408 may be adapted to buffer the output of amplifier 305 (or VINT) as feedback loop 315 is not required to be as fast as feedback loops 320 and 325. Buffer 408 may provide VINT to a level shifter that comprises $M_6$, $M_7$, and $M_8$. A level shifter may be used to level shift VINT to provide bias voltages to feedback loops 320, 325. In some embodiments, transistors $M_6$ and $M_8$ may be P-type transistors and M7 may be an N-type transistors.

In applications requiring a large variable current as well as a large average current, it may be necessary to estimate the average level of $V_{OUT}$ independently of the current $I_{OUT}$. An output stage model may be used in some embodiments to simulate the output stage under zero load conditions so that the internal reference voltage is adjusted to a level such that the output voltage $V_{OUT}$ at a specified constant load current (e.g., zero load current) matches the external reference voltage $V_{REF}$.

Figure 5:
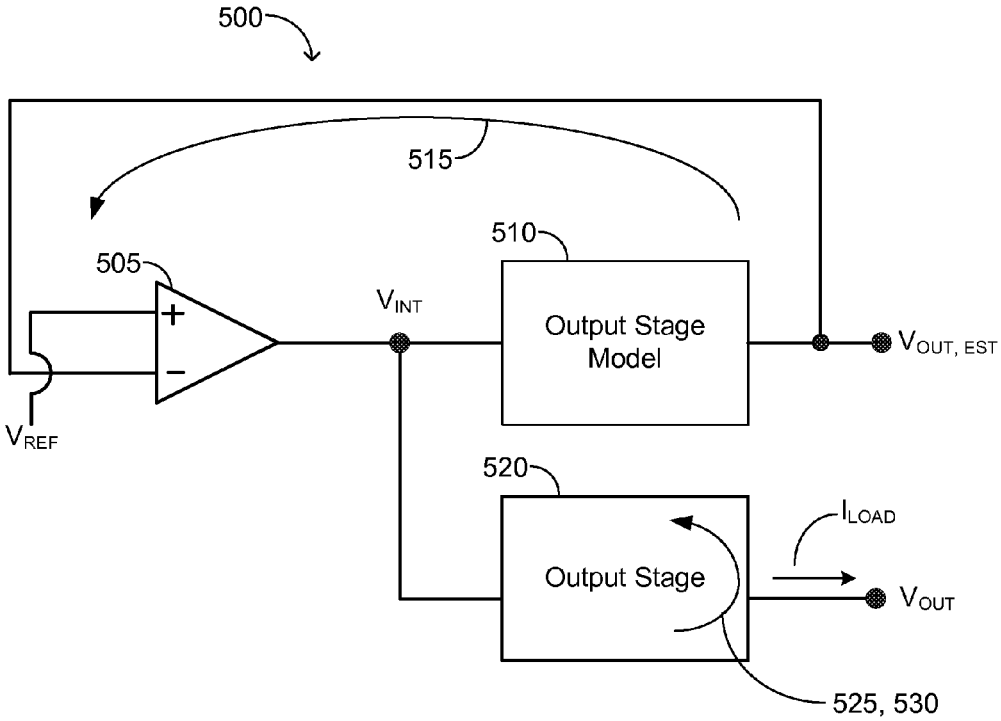
FIG. 5 is a block diagram of yet another embodiment of the present invention shown with multiple output stages.

FIG. 5 is a block diagram of yet another embodiment of the present invention shown with multiple output stages. Voltage regulator 500 may be used to provide a large variable current as well as a large average current. Voltage regulator 500 may include amplifier 505 to receive an external reference voltage $V_{REF}$ at a positive input and generate an internal reference voltage $V_{INT}$. $V_{INT}$ may be connected to the input of an output stage model 510 which may generate an estimated output voltage $V_{OUT,\ EST}$ which is an estimate of the output voltage, $V_{OUT}$, under a constant load. $V_{INT}$ may also be connected to the input of an output stage 520. In some embodiments of the present invention, the output stage model 510 and/or the output stage 520 may have low impedance characteristics. The output stage 520 may include internal feedback loops 525, 530 that adjust $I_{LOAD}$ in response to load changes so that the output voltage $V_{OUT}$ remains substantially constant relative to $V_{INT}$. In some embodiments, $V_{OUT}$ may not be equal to $V_{INT}$, but a constant voltage difference may be maintained between $V_{OUT}$ and $V_{INT}$.

Output stage model 510 may simulate the characteristics of the output stage 520 under a specified constant load condition, e.g., zero load condition. The output stage model 510 may generate an output voltage $V_{OUT,\ EST}$ which may be an estimate of $V_{OUT}$ under a constant load and may be connected to a negative input of differential amplifier 505, forming a feedback loop 515. The feedback loop 515 may cause amplifier 505 to adjust $V_{INT}$ so that $V_{OUT, EST}$ may be substantially equal to $V_{REF}$. Since $V_{OUT, EST}$ may be substantially equal to $V_{REF}$, $V_{OUT}$ may also be substantially equal to $V_{REF}$, as long as the output stage 520 is capable of maintaining $V_{OUT}$ constant under varying load conditions. In other words, in some embodiments, the load current variations may be compensated for by output stage 520 and not by feedback loop 515.

An advantage of using the output stage model 510 is that $V_{OUT}$ is decoupled from $V_{INT}$, so that changes in $V_{OUT}$ do not affect $V_{INT}$. $V_{INT}$ maintains a relatively constant level despite changes in load conditions, and will change mainly in response to changes in the environment (e.g., changes in operating temperature) that affect the operating point of the output stage 520. The delay caused by a slow response time of the feedback loop 515 will have little effect on $V_{OUT}$. Output stage model 510 in voltage regulator 500 allows the output stage 520 to supply a substantial average load current without degrading the transient response of the regulator 500.

Voltage regulator 500 may also achieve smaller peak-to-peak output voltage variations than the prior art voltage regulator 100 under varying load conditions. As an illustration, suppose that voltage regulator 100 is connected to a load that initially requires zero load current so that $V_{OUT}$ may settle to $V_{REF}$. When load current increases to its maximum value, initially $V_{OUT}$ may drop. The amplifier 105 regulates $V_{OUT}$ so that, after some time, $V_{OUT}$ may converge to $V_{REF}$. When the load current suddenly returns to zero, $V_{OUT}$ may temporarily overshoot $V_{REF}$ before it settles back at $V_{REF}$. Such transient response may result in a peak-to-peak variation that is about twice the amount of the initial voltage drop.

Conversely, suppose that voltage regulator 500 is initially loaded with zero-load current. If the output stage model 510 models the conditions under zero load, then $V_{OUT}=V_{OUT, EST}=V_{REF}$. When the load current suddenly increases to its maximum value, $I_{MAX}$, $V_{OUT}$ may drop below $V_{REF}$. $V_{OUT}$ will not affect $V_{INT}$ because the feedback loop 515 does not compare $V_{OUT}$ with $V_{REF}$. If the load current returns to zero, $V_{OUT}$ will converge to $V_{REF}$ without overshooting $V_{REF}$. Therefore, voltage regulator 500 may achieve a peak-to-peak variation of $V_{OUT}$ that is less than, for example, one half the peak-to-peak variation for conventional voltage regulator 100. In some embodiments, output stage model 510 may be a scaled-down replica of the output stage 520 while in others, output stage model 510 may be an exact replica of output stage 520. For example, the output stage model 510 may be a scaled-down version of the output stage 520 having the same circuit configuration as the output stage 520, but the characteristics of the components in output stage model 510 are smaller than those of the output stage 520. A scaled-down output stage model may allow the output stage model 510 to simulate the transfer function of the output stage 520 under various processing and temperature conditions while consuming only a small amount of current, conserving power, and generating less heat energy.

When the load current, $I_{LOAD}$ changes, some variation in output voltage $V_{OUT}$ may couple via parasitic input-output capacitance to $V_{INT}$. One method of reducing the coupling is to connect a decoupling capacitor (not shown) to $V_{INT}$. Another method is to decrease the output impedance of the differential amplifier 505. It is also possible to cascade several stages of differential amplifiers and buffer $V_{INT}$ because high bandwidth in the feedback loop 515 is not required.

Figure 6:
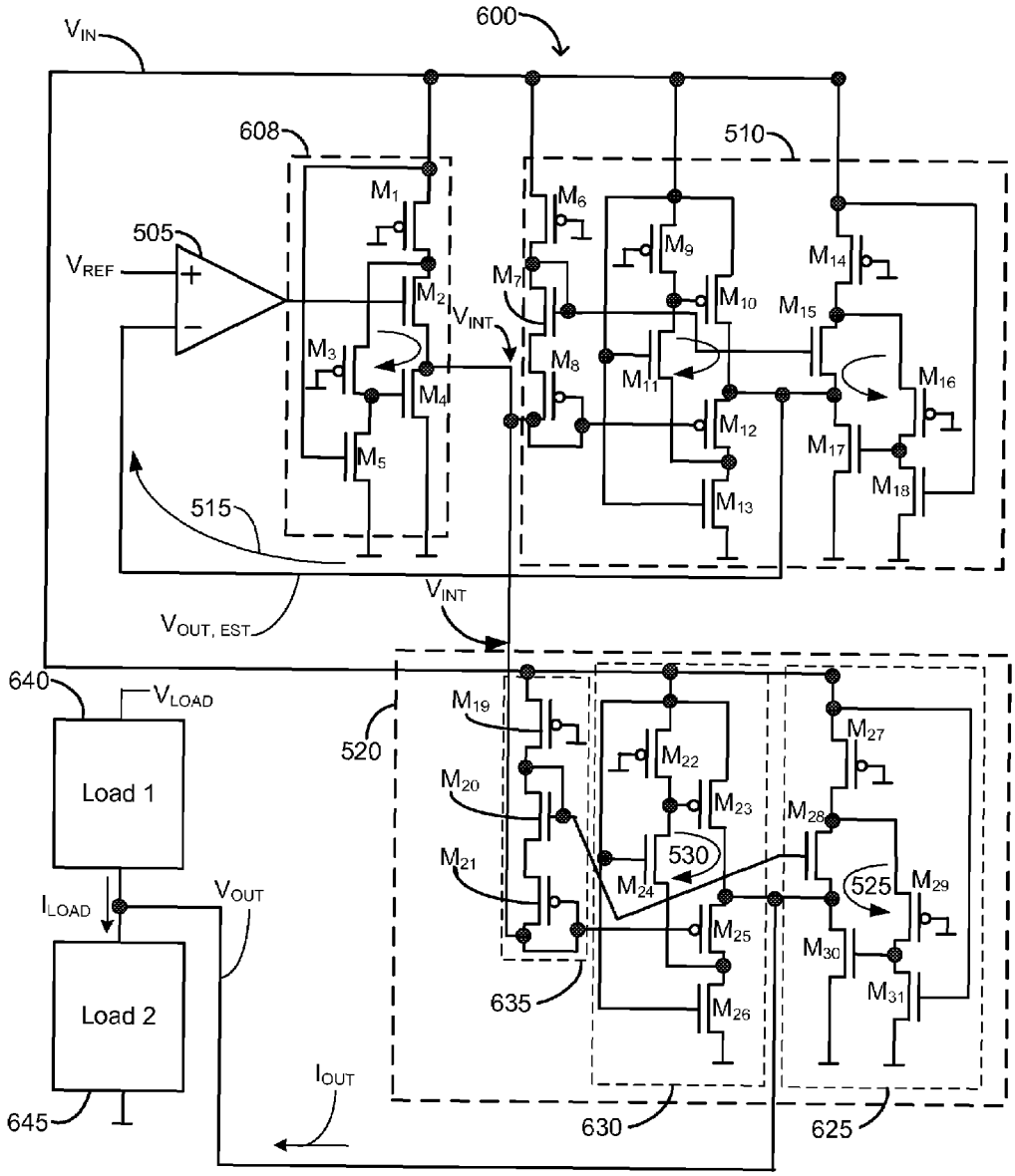
FIG. 6 is a schematic representation of an embodiment of the present invention shown with multiple output stages and multiple loads.

FIG. 6 is a detailed schematic representation of an embodiment of the voltage regulator 500 shown with multiple output stages and multiple loads to eliminate parasitic input-output capacitance to $V_{INT}$. Voltage regulator 500 may comprise amplifier 505, buffer 608, output stage model 510, and output stage 520. In some embodiments, amplifier 505 may receive a reference voltage, $V_{REF}$, at a positive terminal, an estimated output voltage, $V_{OUT, EST}$, at a negative terminal, and may provide an output voltage to buffer 608. Buffer 608 may receive the output voltage from amplifier 505, buffer the output voltage, and may provide $V_{INT}$ to output stage model 510 and output stage 520. Output stage model 510 may be a model of output stage 520 and may generate $V_{OUT, EST}$ which may be provided to amplifier 505 via feedback loop 515. Output stage 520 may receive $V_{INT}$, generate $V_{OUT}$, and may control $V_{OUT}$ so that $V_{OUT}$ approximately equals $V_{INT}$. Also depicted in FIG. 6 are two series connected loads 640, 645. Series connected loads 640, 645 may be digital loads capable of switching at very high frequencies such that $V_{OUT}$ may tend to deviate from a desired predetermined intermediate voltage level. In some embodiments, the intermediate voltage level between loads 640, 645 may be approximately 0.6 volts wherein load 640 may operate using supply voltages of approximately 0.6 volts and 1.2 volts, and load 645 may operate using supply voltages of 0 volts and 0.6 volts. In other embodiments of the present invention, the supply voltages may be any desired voltages such that output stage 520 regulates an intermediate supply voltage between multiple loads.

Output stage 520 may control $V_{OUT}$ with an active pull-down stage 625 and an active pull-up stage 630. Active pull-down stage 625 and active pull-up stage 630 may control $V_{OUT}$ via feedback loops 525 and 530, respectively, and adjust $V_{OUT}$ so that $V_{OUT}$ approximately equals $V_{INT}$. In some embodiments, active pull-down stage 625 may lower $V_{OUT}$ down by sinking (or drawing) current so that $V_{OUT}$ approximately equals $V_{INT}$, and in some embodiments, active pull-up stage 630 may raise $V_{OUT}$ by sourcing current so that $V_{OUT}$ approximately equals $V_{INT}$. Feedback loops 525 and 530 may be biased for proper operation with bias voltages provided by level shifter 635. Level shifter 635 may receive $V_{INT}$ to provide bias voltages to pull-down stage 625 and pull-up stage 630. Because output stage 520 may track load current changes, output stage 520 may be a simple output circuit and feedback loops 525 and 530 may have much lower delay as compared to feedback loop 515. This in turn may result in faster response times and may also result in smaller decoupling capacitors in some embodiments of the present invention.

By using an output stage 520 with fast internal feedback loops 525 and 530, the output stage 520 may generate an appropriate $I_{OUT}$ so that the $V_{OUT}$ tracks the $V_{INT}$ when load conditions change rapidly and tend to cause $V_{OUT}$ to rise above or fall below $V_{INT}$. Because $V_{OUT}$ may be adjusted by the fast internal feedback loops 525 and 530 of output stage 520, it may not be necessary to use amplifier 505 to track changes in the loads 640, 645. Amplifier 505 may only have to adjust $V_{INT}$ so that $V_{OUT}$ does not vary with temperature or manufacturing tolerances. Delay in the feedback loop 515 formed by the amplifier 505 and the output stage model 510 will have little effect on the ability of the output stage 520 to adjust to variations in load 640, 645.

Feedback loops 525 and 530 may adjust $V_{OUT}$ so that $V_{OUT}$ approximates $V_{INT}$. Feedback loop 525 may comprise transistors $M_{28}$, $M_{29}$, $M_{30}$, and $M_{31}$. In some embodiments, $M_{28}$ may be an N-type transistor, $M_{29}$ may be a P-type transistor, $M_{30}$ may be an N-type transistor, and $M_{31}$ may be an N-type transistor. As illustrated in FIG. 5, $V_{INT}$ may be level shifted via level shifter 525 to provide an appropriate bias voltage to the gate of $M_{28}$ while the gate of $M_{29}$ may be connected to a supply voltage of zero potential or ground. Level shifter 525 may comprise $M_{19}$, $M_{20}$, and $M_{21}$ and in some embodiments, $M_{19}$ and $M_{21}$ may be a P-type transistor and $M_{20}$ may be an N-type transistor. When $V_{OUT}$ rises above $V_{INT}$, feedback loop 525 sinks current via transistors $M_{28}$, $M_{29}$, $M_{30}$, and $M_{31}$ so that $V_{OUT}$ is lowered to approximate $V_{INT}$.

Feedback loop 530 may comprise transistors $M_{23}$, $M_{24}$, and $M_{25}$. In some embodiments, $M_{23}$ may be a P-type transistor, $M_{24}$ may be an N-type transistor, and $M_{25}$ may be a P-type transistor. $V_{INT}$ may be connected to bias the gate of $M_{25}$ while the gate of $M_{24}$ may be biased by $V_{INT}$. When $V_{OUT}$ falls below $V_{INT}$, feedback loop 530 sources current via transistors $M_{23}$, $M_{24}$, and $M_{25}$ so that $V_{OUT}$ is raised back to the level of approximately $V_{INT}$. Those skilled in the art will understand that the circuit configurations comprising feedback loops 525 and 530 are exemplary and that other configurations are possible to achieve active pull-up and pull-down voltage regulation. The active regulation capabilities of feedback loops 525 and 530 provide internal feedback loops with fast response times so that voltage regulator 500 can quickly adjust $V_{OUT}$ to approximate $V_{INT}$ when the intermediate voltage between loads 640, 645 fluctuates. One advantage of output stage 520 is that it has a small feedback loop delay, thus it can operate at higher frequencies. Other advantages include a stable output stage that may not oscillate, a $V_{OUT}$ that remains substantially constant despite changes in $I_{OUT}$, and an output stage that may generate a $V_{OUT}$ close to $V_{IN}$.

Figure 7:
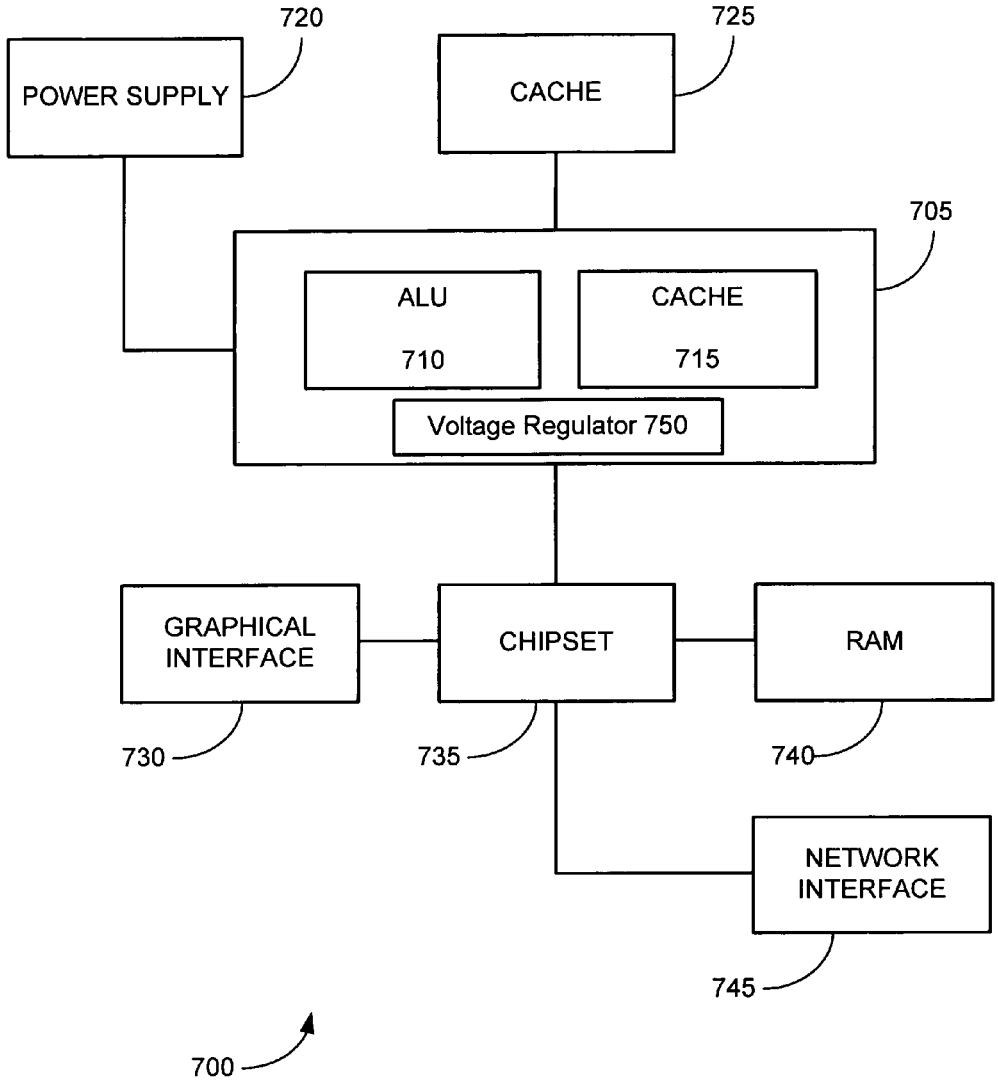
FIG. 7 is a block diagram of a system embodiment of the present invention.

FIG. 7 is a block diagram of a system embodiment of the present invention. As shown system 700 may comprise high speed digital circuits including processor 705, arithmetic logic unit (ALU) 710, memory caches 715, 725, power supply 720. System 700 may further comprise graphical interface 730, chipset 735, memory 740, and a network interface 740 all of which may be connected to processor 705. Processor 705 may include voltage regulator 750 which may regulate the intermediate voltages between graphical interface 730, chipset 735, memory 740, and network interface 745. In other embodiments of the present invention, more than one voltage regulator circuit may be used to regulate multiple intermediate voltages between high speed digital circuits. Although voltage regulator 750 is shown as a component of processor 705, voltage regulator may not be a processor component or may be reside on a different high speed digital circuit.

Figure 8:
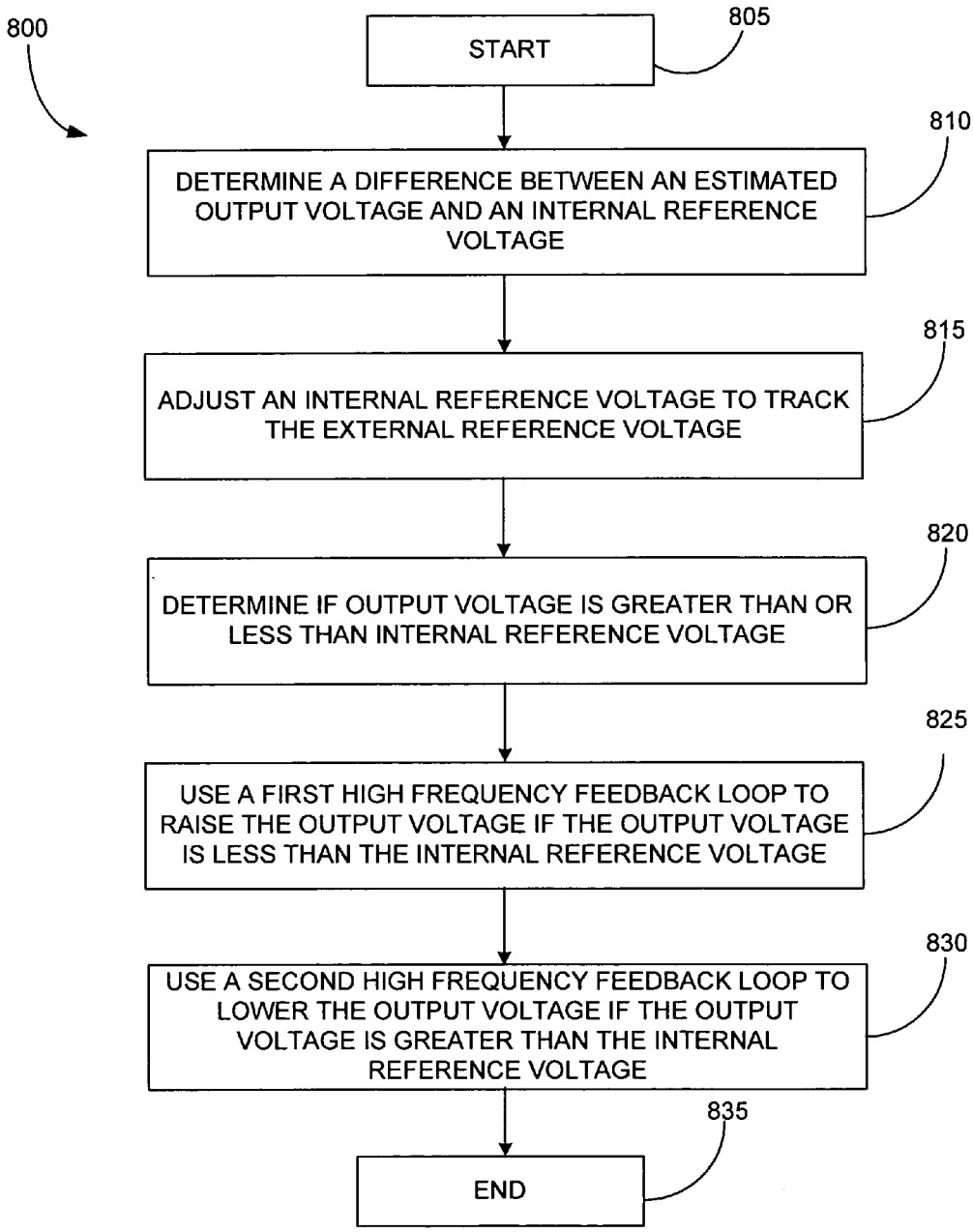
FIG. 8 is a logic flow diagram of a method embodiment of the present invention.

FIG. 8 is a logic flow diagram of a method 800 in accordance with some embodiments of the present invention. The method 800 may be used to control an output voltage provided to a plurality of series connected digital loads such that the output voltage may track an external reference voltage. Method 800 starts at 805, and at 810, a difference between an estimated output voltage and the external voltage may be determined. At 815, an internal reference voltage may be adjusted based on the difference between the estimated output voltage and the external reference voltage such that internal reference voltage tracks the external reference voltage. Next at 820, the output voltage may be read to determine if it is greater or less than the internal reference voltage. If the output voltage is less than the internal reference voltage, then a first high frequency feedback loop may be used to raise the output voltage at 825 by sourcing current to the loads. If the output voltage is greater than the internal reference voltage, then a second high frequency feedback loop may be used to lower the output voltage at 830 to lower the output voltage by sinking current from the loads. Method 800 may continuously repeated ensuring that the output voltage remains substantially constant to an external reference voltage.

The various embodiments of the present invention may be utilized in any environment where an output voltage needs to be regulated. For example, some of the various embodiments of the present invention may be particularly suitable for on-die power conversion where a lower secondary output voltage with capabilities of sourcing and sinking current to regulate an output voltage is desired. Some embodiments of the present invention may be used in conjunction with microprocessors with a digital load operating between a supply voltage to an intermediate voltage and another digital load operating between the intermediate voltage and a voltage lower than the intermediate voltage. Still yet some embodiments of the present invention may be used to regulate the intermediate voltage between high speed digital circuits in a system embodiment while other embodiments may be used for body bias voltage generation.

The various embodiments of the present invention have been described with reference to the above discussed embodiments, but the present invention should not be construed to cover only these embodiments. Rather, these embodiments are only exemplary embodiments. Additionally, variations of the above exemplary embodiments may suggest themselves to those skilled in the art or others without departing from the spirit and scope of the present invention. The appended claims and their full range of equivalents should, therefore, only define the full scope of the present invention.

We claim:

1. A device comprising:

an output stage to control a current delivered to or received from a load to maintain an output voltage substantially constant relative to an internal reference voltage, wherein the output stage comprises:

an active pull-up circuit to source the current when the output voltage is less than the internal reference voltage; and an active pull-down stage to sink the current when the output voltage is greater than the internal reference voltage;

a feedback circuit coupled to the output stage, to receive the output voltage, and to provide the internal reference voltage to the output stage, wherein the feedback circuit is configured to maintain the internal reference voltage substantially constant relative to an external reference voltage; and a level shifter to level shift the internal reference voltage to match a predetermined bias voltage to bias the output stage, the level shifter comprising two P-type transistors and an N-type transistor, each having a drain, a source, and a gate, wherein:

the source of the first P-type transistor is connected to a first supply voltage, the gate of the first P-type transistor is connected to a second supply voltage, and the drain of the first P-type transistor is connected to the drain and gate of the N-type transistor; and the source of the second P-type transistor is connected to the source of the N-type transistor, the gate of the second P-type transistor is connected to the drain of the second P-type transistor, and the drain of the second P-type transistor is connected to the internal reference voltage.

2. The device of claim 1 wherein the feedback circuit comprises an amplifier having:

a negative input to receive the output voltage;

a positive input to receive the external reference voltage; and an output to provide the internal reference voltage, wherein the internal reference voltage represents an amplified difference between the output voltage and the internal reference voltage.

3. The device of claim 1, wherein the active pull-down circuit comprises an internal high frequency feedback loop to draw an incremental current from the current such that the output voltage is lowered to approximately equal the internal reference voltage.

4. The device of claim 1, wherein the active pull-up circuit comprises an internal high frequency feedback loop to provide an incremental current to the current such that the output voltage is raised to approximately equal the internal reference voltage.

5. The circuit of claim 1 wherein the active pull-up stage comprises a first and second P-type transistor, each having a drain, a source, and a gate, wherein:

the drain of the first P-type transistor generates the output voltage and is connected to the source of the second P-type transistor, the source of the first P-type transistor is connected to a supply voltage, and the gate of the first P-type transistor is connected to a bias voltage; and the gate of the second P-type transistor is connected to the internal reference voltage, and the drain of the second P-type transistor is connected to a second bias voltage.

6. The circuit of claim 5 wherein the active pull-up stage further comprises an N-type transistor having a drain, a source, and a gate, wherein the drain of the first N-type transistor is connected to the gate of the first P-type transistor, the gate of the first N-type transistor is connected to the supply voltage, and the source of the first N-type transistor is connected to the drain of the second P-type transistor.

7. The circuit of claim 1, wherein the active pull-down stage comprises two N-type transistors and a P-type transistor, each having a drain, a source, and a gate, wherein:

the drain of the first N-type transistor is connected to the source of the P-type transistor, the gate of the first N-type transistor is connected to the internal reference voltage, and the source of the first N-type transistor generates the output voltage; and the drain of the second N-type transistor is connected to the source of the first N-type transistor, the gate of the second N-type transistor is connected to the drain of the P-type transistor, and the source of the second N-type transistor and the gate of the P-type transistor is connected to a second supply voltage.

8. A method comprising:

controlling an output voltage to track an external reference voltage in response to a load current;

sourcing the load current using a high frequency active push-up feedback loop to raise the output voltage if the output voltage is less than an internal reference voltage;

sinking the load current using a high frequency active push-down feedback loop to lower the output voltage if the output voltage is greater than the internal reference voltage;

controlling the internal reference voltage using a low frequency feedback loop to track the internal voltage to the external reference voltage; and providing a level shifter to level shift the internal reference voltage, the level shifter comprising two P-type transistors and an N-type transistor, each having a drain, a source, and a gate, wherein:

the source of the first P-type transistor is connected to a first supply voltage, the gate of the first P-type transistor is connected to a second supply voltage, and the drain of the first P-type transistor is connected to the drain and gate of the N-type transistor; and the source of the second P-type transistor is connected to the source of the N-type transistor, the gate of the second P-type transistor is connected to the drain of the second P-type transistor, and the drain of the second P-type transistor is connected to the internal reference voltage.

9. The method of claim 8 further comprising raising the output voltage to approximately equal to the internal reference voltage.

10. The method of claim 8 further comprising lowering the output voltage to approximately equal to the internal reference voltage.

11. The method of claim 8 further comprising generating the internal reference voltage by amplifying a difference between the output voltage and the external reference voltage.

12. The method of claim 8 further comprising buffering the internal reference voltage such that the output voltage adjusts faster than the internal reference voltage.

13. A system comprising:

a voltage regulator receiving a reference voltage and generating an internal reference voltage to produce an output voltage, the voltage regulator comprising an active pull-up stage and an active push-down stage connected in parallel, wherein the stages comprise an internal feedback loop to actively adjust the output voltage such that the output voltage approximately equals the internal reference voltage;

a node located between two loads and connected to the output voltage, wherein the voltage regulator adjusts the output voltage supplied to the node such that the current supplied to the loads is approximately equal; and a level shifter to level shift the internal reference voltage, the level shifter comprising two P-type transistors and an N-type transistor, each having a drain, a source, and a gate, wherein:

the source of the first P-type transistor is connected to a first supply voltage, the gate of the first P-type transistor is connected to a second supply voltage, and the drain of the first P-type transistor is connected to the drain and gate of the N-type transistor; and the source of the second P-type transistor is connected to the source of the N-type transistor, the gate of the second P-type transistor is connected to the drain of the second P-type transistor, and the drain of the second P-type transistor is connected to the internal reference voltage.

14. The system of claim 13 wherein one of the loads is a memory.

15. The system of claim 14 wherein one of the loads is a data processor.

* * * * *